US005494540A

United States Patent [19]

Ochi et al.

[11] Patent Number: 5,494,540

[45] Date of Patent: Feb. 27, 1996

[54] ABRASION-RESISTANT ALUMINUM ALLOY AND METHOD OF PREPARING THE SAME

[75] Inventors: Shigeki Ochi; Tosio Fujiwara, both of Hyogo, Japan

[73] Assignee: Sumitomo Electric Industries, Ltd., Osaka, Japan

[21] Appl. No.: 379,084

[22] Filed: Jan. 26, 1995

Related U.S. Application Data

[63] Continuation of Ser. No. 206,965, Mar. 7, 1994, abandoned.

[30] Foreign Application Priority Data

Apr. 6, 1993 [JP] Japan ..... 5-103661

[51] Int. Cl.[6] ..... C22F 1/04; C22C 21/08

[52] U.S. Cl. ..... 148/552; 148/691; 148/439; 420/534; 420/538; 420/546; 420/547; 420/549; 420/550

[58] Field of Search ..... 420/534, 538, 420/546, 547, 549, 550; 148/439, 552, 550, 691, 417

[56] References Cited

U.S. PATENT DOCUMENTS 4,077,810 3/1978 Ohuchi et al. ..... 148/439

FOREIGN PATENT DOCUMENTS 52-39514 3/1977 Japan .

53-20244 6/1978 Japan ..... 420/534

53-137811 12/1978 Japan .

*Primary Examiner*—David A. Simmons

*Assistant Examiner*—Robert R. Koehler

*Attorney, Agent, or Firm*—W. G. Fasse; W. F. Fasse

[57] ABSTRACT

An abrasion-resistant aluminum alloy consists of 13.0 to 16.0 percent by weight of Si, 4.0 to 5.0 percent by weight of Cu, at least 0.8 and less than 1.4 percent by weight of Mg, not more than 0.8 percent by weight of Fe, not more than 0.1 percent by weight of either P or at least one of Na, Sb and Sr and a remainder of Al and unavoidable impurities. The alloy's microstructure contains coarse Si particles of 15 to 40 μm mean particle diameter, fine Si particles of not more than 5 μm mean particle diameter and other fine particles, with a homogeneous dispersion of all of these particles. This abrasion-resistant aluminum alloy has specific abrasion loss of not more than $10\times10^{-7}$ $mm^2/kg$.

20 Claims, 2 Drawing Sheets

50 μm

50 μm

50 μm

ABRASION-RESISTANT ALUMINUM ALLOY AND METHOD OF PREPARING THE SAME

This application is a continuation of application Ser. No. 08/206,965, filed on Mar. 7, 1994, now abandoned.

FIELD OF THE INVENTION

The present invention relates to an aluminum (Al) alloy containing silicon (Si), and more particularly, it relates to an abrasion-resistant aluminum alloy which is excellent in strength and toughness as well as abrasion resistance and plastic workability, and a method of preparing the same.

BACKGROUND INFORMATION

In order to reduce the weight of an automobile, machine parts made of an aluminum alloy containing Si are increasingly employed in place of ferrous machine parts in recent years. In such an Al-Si alloy, the abrasion resistance is extremely improved while the thermal expansion coefficient is reduced and the rigidity is improved, due to the addition of Si. In more concrete terms, an abrasion-resistant aluminum alloy AC8A, an abrasion-resistant cast/forged alloy A390, and an Al-Si alloy obtained by powder metallurgy (PM) have been prepared and put into practice.

However, the AC8A alloy is inferior in abrasion resistance due to a comparatively small content of Si, although the alloy has excellent heat resistance and strength. The A390 alloy on the other hand, is excellent in abrasion resistance with an Si content of 17 to 18 percent by weight, but pro-eutectic Si particles are increased to about 80 μm in size, and hence the cuttability of the alloy is deteriorated to easily cause premature abrasion of a cutting tool. Furthermore, the A390 alloy has inferior plastic workability and toughness. When the A390 alloy is subjected to plastic working such as extrusion or forging after casting, in order to improve the alloy structure for overcoming the aforementioned disadvantages, the coarse Si particles themselves are broken and defects such as pores and voids are caused in interfaces between the Si particles and a matrix material due to their different deformabilities, possibly leading to a deterioration in strength.

In order to compensate for such disadvantages of the A390 alloy, a small amount of an element such as phosphorus (P) may be added to the alloy for suppressing the growth of pro-eutectic Si particles, or the cooling rate during casting may be increased to reduce pro-eutectic Si particle diameters. However, reduction of the Si particles by adding P or the like can be achieved only to a limited extent while increasing the cooling rate for the cast alloy is problematic particularly in view of limitations of the equipment for preparing the same and restrictions depending on the shape and dimensions of the product.

In the Al-Si alloy prepared by powder metallurgy, on the other hand, it is possible to extremely improve heat resistance and abrasion resistance. This is because the alloy tolerance is increased by using rapidly solidified powder which is prepared by air atomization or the like. This allows the introduction of a large amount of Si and addition of a transition metal element such as Fe, Ni, Mn, Cu or Mg and achieves an extreme reduction of pro-eutectic Si particles as compared with a fusion casting method. However, the powder metallurgy method, which requires a high-priced powder raw material and complicated preparation steps, is economically disadvantageous as compared with the fusion casting method.

SUMMARY OF THE INVENTION

In consideration of the aforementioned circumstances, an object of the present invention is to provide an Al-Si aluminum alloy that can be prepared by a fusion casting method having excellent productivity with a low cost. The alloy shall have sufficient strength and toughness as well as excellent cuttability and plastic workability, and particularly shall have abrasion resistance extremely superior to that in the prior art.

An abrasion-resistant aluminum alloy according to the present invention consists of 13.0 to 16.0 percent by weight of Si, 4.0 to 5.0 percent by weight of Cu, 0.7 to 1.4 percent by weight of Mg, not more than 0.8 percent by weight of Fe, not more than 0.1 percent by weight of either P or at least one of Na, Sb and Sr and a remainder of Al and unavoidable impurities. The alloy contains coarse Si particles 15 to 40 μm in mean particle diameter, fine Si particles not more than 5 μm in mean particle diameter and other deposits, with a homogeneous dispersion of these components.

A method of preparing an abrasion-resistant aluminum alloy according to the present invention comprises the steps of casting an aluminum alloy consisting of 13.0 to 16.0 percent by weight of Si, 4.0 to 5.0 percent by weight of Cu, 0.7 to 1.4 percent by weight of Mg, not more than 0.8 percent by weight of Fe, not more than 0.1 percent by weight of either P or at least one of Na, Sb and Sr, and a remainder of Al and unavoidable impurities, and then carrying out hot plastic working on this aluminum alloy at a working rate of at least 30% for homogeneously dispersing coarse Si particles 15 to 40 μm in mean particle diameter, fine Si particles not more than 5 μm in mean particle diameter and other deposits.

The foregoing and other objects, features, aspects and advantages of the present invention will become more apparent from the following detailed description of the present invention when taken in conjunction with the accompanying drawings.

Figure 1:
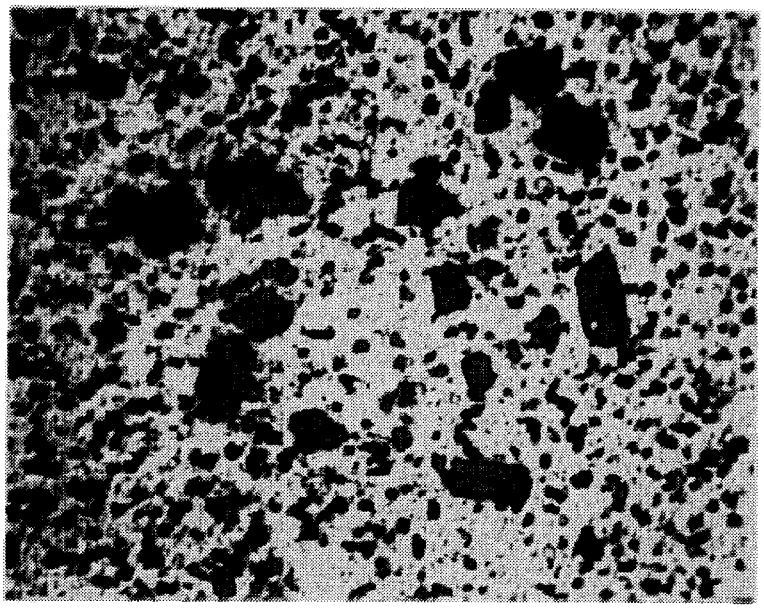
FIG. 1 is a microphotograph showing a metallographic structure of an aluminum alloy of a sample 1, according to the invention in Example 1.

DETAILED DESCRIPTION OF PREFERRED EXAMPLE EMBODIMENTS AND OF THE BEST MODE OF THE INVENTION

According to the present invention, it is possible to remarkably improve abrasion resistance, cuttability and plastic workability of an aluminum alloy which is prepared by a fusion casting method, while simultaneously improving strength, toughness and ductility, by optimizing the composition of the aluminum alloy and controlling the particle diameters and distribution of pro-eutectic and eutectic Si particles and other deposits in the alloy structure. In more concrete terms, the aluminum alloy according to the present invention has a tensile strength of at least 38 $kgf/mm^2$ and an abrasion resistance of not more than $10\times10^{-7}$ $mm^2/kg$ in specific abrasion loss.

The abrasion-resistant aluminum alloy according to the present invention is obtained by casting an Al alloy by a fusion casting method while controlling its composition as described above and thereafter carrying out hot plastic working such as extrusion or forging on this Al alloy. The cooling rate in casting particularly influences the sizes of pro-eutectic Si particles such that the particle diameters of the pro-eutectic Si particles are reduced as the cooling rate is increased. In this context, a cooling rate of about 10° to 50° C./sec. is preferable in general, in order to bring the Si particles into proper sizes according to the present invention. Hot plastic working is carried out on the as-cast alloy to further make finely spherical or macerate the Si particles and other deposits which are contained in the alloy and re-disperse the same. To this end, it is necessary to carry out the hot plastic working at a working rate of at least 30%.

Such an Al alloy according to the present invention contains Si, Cu, Mg and Fe as essential alloy components. Si is an element forming pro-eutectic and eutectic Si particles for increasing strength and improving abrasion resistance. However, cuttability and plastic workability are reduced when the Si content is increased. The optimum Si content is in a range of 13.0 to 16.0 percent by weight, because the pro-eutectic Si particles are reduced too much and sufficient abrasion resistance cannot be attained if the Si content is less than 13.0 percent by weight, while the pro-eutectic Si particles are excessively increased in size to about 80 μm which deteriorates cuttability, plastic workability, toughness and ductility, if the Si content exceeds 16.0 percent by weight.

Cu has the effects of improving yield strength and hardness by solid solution reinforcement, while improving abrasion resistance and fatigue strength by aging treatment. However, an insufficient improvement in strength is attained if the Cu content is less than 4.0 percent by weight, while disadvantageous influences are exerted on forgibility and corrosion resistance if the Cu content exceeds 5.0 percent by weight.

Mg contributes to solid Mg contributes to solid solution reinforcement and deposition reinforcement, and improves strength and hardness. However, the deposition reinforcing effect is reduced and an insufficient improvement is attained in strength and hardness if the Mg content is less than 0.7 percent by weight, while a disadvantageous influence is exerted on corrosion resistance and forgibility of the alloy, i.e. these properties are reduced, if the Mg content exceeds 1.4 percent by weight.

Fe forms deposits, so that Fe forms deposits, so that heat resistance and burning resistance are remarkably improved with increase in its content. However, the deposits are increased in size which leads to inhomogeneization of the structure and deterioration in ductility and cuttability if the Fe content exceeds 0.8 percent by weight.

The inventive alloy may also contain Ni and/or Mn, in addition to the aforementioned components. Ni forms deposits similarly to Fe, to provide an improvement in heat resistance and burning resistance when its content is increased. However, the arbitrarily added element Ni also forms a large amount of needle-like coarse deposits which extremely reduce forgibility, strength and toughness if the Ni content exceeds 0.5 percent by weight. On the other hand, Mn, which is also an arbitrarily added element, makes spherical and refines the Fe deposits and Al-Fe-Si deposits to improve fatigue strength, while the same deteriorates forgibility and toughness if the Fe content exceeds 0.5 percent by weight.

Further, P refines the pro-eutectic Si particles to proper sizes, while Na, Sb and Sr have the effects of refining the eutectic Si particles and improving toughness. However, the contents of P, Na, Sb and Sr must be not more than 0.1 percent by weight in total. This is because no further improvement of the advantageous, effects is achieved but the strength and elongation are reduced in the element such as Na which suppresses growth of the pro-eutectic Si particles, if the total content exceeds 0.1 percent by weight. In casting, it is not preferable to add P, which suppresses growth of the pro-eutectic Si particles, simultaneously with Na, Sb and Sr, which suppress growth of the eutectic Si particles, because the effects of these elements are reduced in this case. Thus, only P or at least one of Na, Sb and Si is added, while it is preferable to cast the alloy while adding only P for refining the pro-eutectic Si particles and thereafter carry out hot plastic working such as extrusion or forging on this cast alloy.

As to the alloy structure, it is necessary to control coarse Si particles based on pro-eutectic Si to intermediate sizes between those of Si particles contained in the conventional A390 alloy and those of Si particles contained in an alloy prepared by powder metallurgy. According to the invention proper sizes of coarse pro-eutectic Si particles are about 15 to 40 μm in mean particle diameter. Furthermore, it is necessary to refine fine Si particles based on eutectic Si to not more than 5 μm in mean particle diameter. It is also necessary to homogeneously distribute the above described these particles. The pro-eutectic Si particle diameters are remarkably influenced by the Si content in the alloy composition as described above, while the pro-eutectic Si particles are refined by increasing the cooling rate for the cast alloy and adding P. In order to refine the eutectic Si particles, on the other hand, it is effective to increase the cooling rate for the cast alloy, carry out hot plastic working such as forging or extrusion and increase the temperature or the time for the heat treatment, in addition to controlling of the alloy composition and adding of an element such as Na for suppressing growth of the eutectic Si particles.

In the inventive abrasion-resistant aluminum alloy, the volume ratio (coarse particles/fine Si) of the hereinafter identified as, coarse Si particles 15 to 40 μm in mean particle diameter and based on pro-eutectic Si, relative to the fine Si particles not more than 5 μm in mean particle diameter and based on eutectic Si, and other deposits is preferably within a range of 0.4 to 2.5. This is because abrasion resistance and fatigue strength of the alloy are reduced if the volume ratio of coarse Si/fine particles is less than 0.4, while cuttability and plastic deformability are deteriorated due to an increase of the coarse Si particles if the volume ratio exceeds 2.5.

In order to control the volume ratio of coarse Si/fine particles in the range of 0.4 to 2.5, it is necessary to suppress the contents of P, which suppresses growth of the pro-eutectic Si particles, and Na, Sb and Si, which suppress growth of the eutectic Si particles, to not more than 0.1 percent by weight in total, and/or to control the cooling rate in casting the alloy to be in a range of 10° to 35° C./sec. Preferably, the cooling rate for casting is controlled to be 25° to 30° C./sec., to control the volume ratio of coarse Si/fine particles to be in a range of 1.0 to 2.2.

EXAMPLE 1

Al-Si alloys having alloy compositions shown in Table 1 were cast by a fusion casting method, to prepare billets having outer diameters of 182 mm and 100 mm respectively. Faces of the respective billets were removed by cutting work, and the billets were thereafter cut to obtain billets for extrusion having outer diameters of 175 mm and lengths of 600 mm and billets for forging having outer diameters of 95 mm and lengths of 70 mm. For the purpose of comparison, conventional A390 alloys were prepared by a fusion casting method and powder metallurgy respectively, to obtain billets for extrusion and forging similarly to the above. In the fusion casting method, both of the alloys according to the inventive example and the comparative example were cooled at cooling rates of 28° C./sec.

Thereafter the billets for extrusion of the Al-Si alloys were heated at 420° C. for 1 hour, extruded into round bars having a 50 mm outer diameter at a working rate of 72%, and thereafter heated at 480° C. for 1 hour, water-hardened and tempered at 170° to 180° C. for 6 hours through T6 heat treatment. On the other hand, the billets for forging were heated at 400° C. for 30 minutes, upset-forged with a mechanical forging press into tablets having a 120 mm outer diameter at a working rate of 68%, and thereafter subjected to T6 heat treatment similarly to the above. Table 1 also shows the types and the working rates of hot plastic working for the respective samples.

TABLE 1

| | Alloy Composition (wt./%) | | | | | | | |
|---|---|---|---|---|---|---|---|---|
| Sample | Si | Cu | Mg | Fe | Mn | Ni | Other Element | Hot Plastic Working Working Rate (%) |
| 1 | 13.2 | 4.7 | 1.0 | 0.2 | 0.3 | — | P = 0.018 | Extrusion (72) |
| 2 | 14.0 | 4.4 | 0.8 | 0.5 | 0.1 | — | P = 0.015 | Extrusion (72) |
| 3 | 15.3 | 4.3 | 1.0 | 0.4 | — | — | P = 0.02 | Extrusion (72) |
| 4 | 14.5 | 4.1 | 1.3 | 0.7 | 0.05 | — | Sb = 0.05 | Forging (68) |
| 5 | 15.2 | 4.5 | 1.2 | 0.25 | — | 0.5 | Na + Sb = 0.01 | Extrusion (72) |
| 6 | 15.8 | 4.2 | 0.9 | 0.3 | 0.01 | — | P = 0.02 | Extrusion (72) |
| 7 | 15.0 | 4.5 | 1.1 | 0.3 | 0.02 | — | P = 0.02 | Forging (68) |
| 8 | 15.3 | 4.3 | 1.0 | 0.4 | — | — | Sb = 0.03 | Extrusion (72) |
| 9 | 14.0 | 4.4 | 0.8 | 0.4 | 0.1 | 0.2 | P = 0.02 | Extrusion (72) |
| 10 | 15.2 | 4.1 | 1.0 | 0.3 | — | — | P = 0.02 | Extrusion (72) |
| 11* | 17.0 | 4.3 | 0.6 | 0.3 | 0.3 | 0.8 | P = 0.02 | Extrusion of Forged A390 (72) |
| 12* | 12.0 | 4.5 | 0.8 | 1.2 | 0.3 | 0.6 | P = 0.02 | Extrusion of Forged A390 (72) |
| 13* | 15.0 | 3.5 | 0.5 | 0.2 | 0.02 | — | P = 0.02 | Forging of Cast A390 (68) |
| 14* | 17.0 | 4.3 | 0.6 | 0.3 | 0.3 | 0.8 | P = 0.02 | Forging of PM-A390 (68) |
| 15* | 12.0 | 4.5 | 0.8 | 1.2 | 0.3 | 0.6 | P = 0.02 | Extrusion of PM-A390 (72) |

*comparative samples

Figure 2:
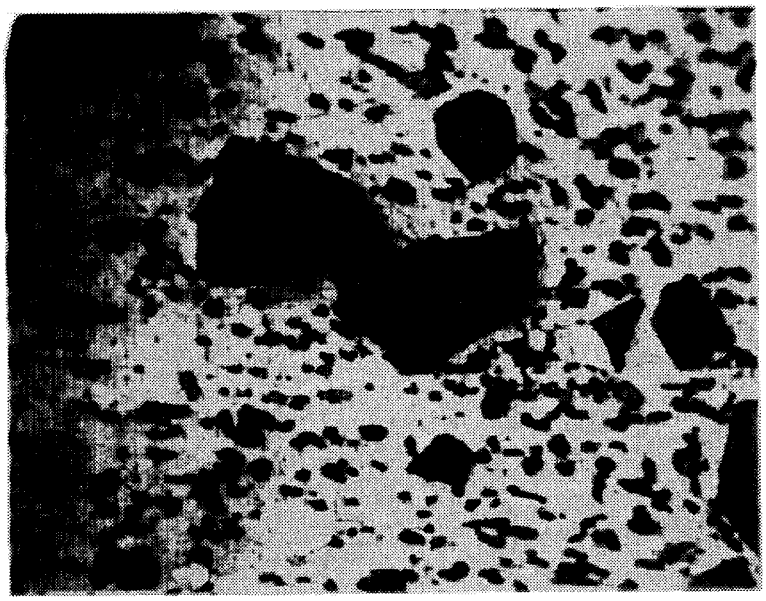
FIG. 2 is a microphotograph showing a metallographic structure of an A390 alloy prepared by a fusion casting method as a comparative sample 11 in Example 1.

Test pieces were cut from the respective Al-Si alloy samples obtained through the aforementioned extrusion and forging, and the metallographic structures thereof were observed with a microscope to measure mean particle diameters of coarse Si particles and fine Si particles, including other fine deposited particles, thereby obtaining volume ratios of the coarse Si particles to the fine particles. FIGS. 1 and 2 are microphotographs showing the metallographic structures of the inventive sample 1 according to the present Example and the comparative sample 11 (A390 alloy prepared by the fusion casting method) respectively. Comparing FIGS. 1 and 2 with each other, it is understood that coarse particles (large grey portions) of pro-eutectic Si in the Al-Si alloy of the inventive sample 1 (FIG. 1) are smaller than those in the conventional A390 alloy (FIG. 2), and fine particles (small grey portions) of eutectic Si and the like are further refined and more homogeneously dispersed in the former as compared with the latter.

Figure 3:
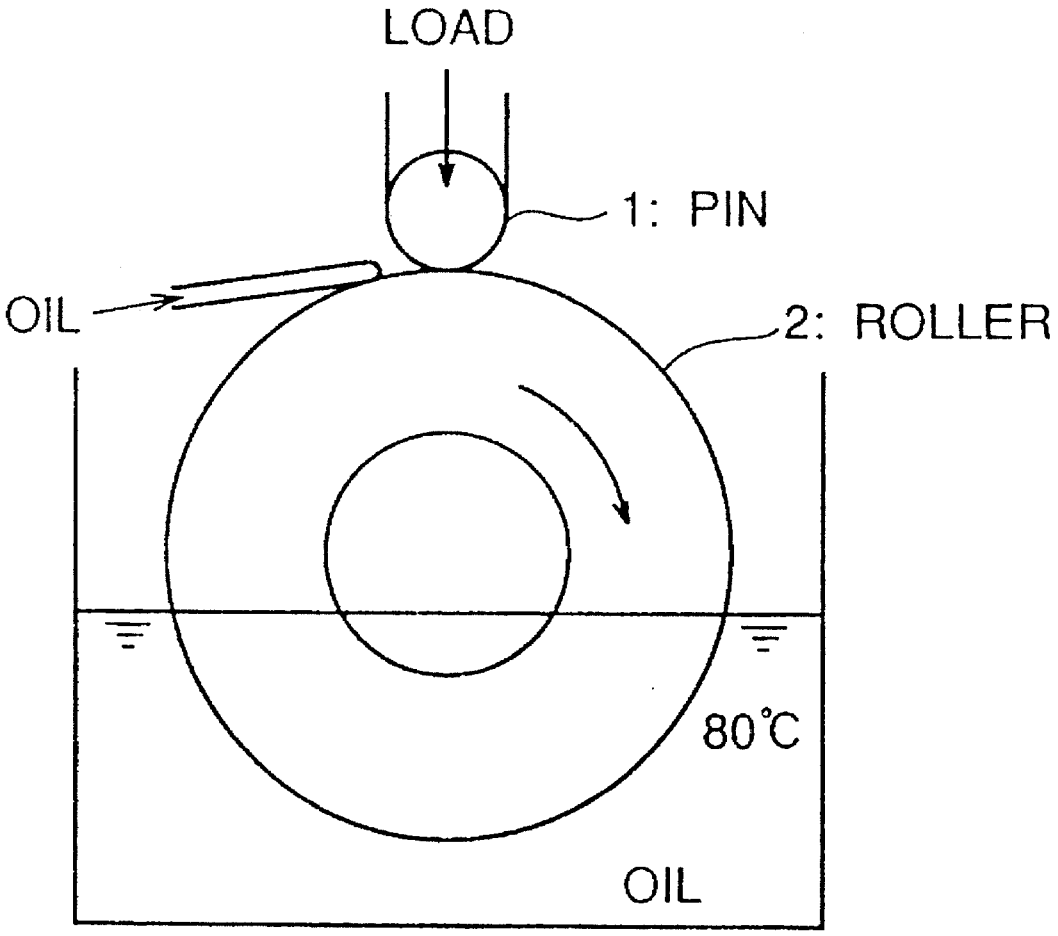
FIG. 3 is a diagram for schematically illustrating an abrasion resistance test employed in Example 1.

Further, the test pieces which were cut from the respective Al-Si alloy samples were subjected to measurement of hardness as well as tensile strength and elongation by a tensile test. In addition, a pin 1 of each Al-Si alloy was pressed against a roll 2 of cast iron, which was rotated at a speed of 415 rpm, under a load of 30 kgf with oil lubrication in an abrasion test as shown in FIG. 3, to obtain specific abrasion loss after a friction time of 20 hours. Table 2 shows the test results.

TABLE 2

| | Mean Particle Diameter (μm) | | Coarse Si/Fine Particle Volume | Tensile Strength | Elongation | Hardness | Specific Abrasion Loss (× |
|---|---|---|---|---|---|---|---|
| Sample | Coarse Si | Fine | Ratio | (kgf/mm$^2$) | (%) | ($H_RB$) | $10^{-7}$ mm$^2$/kg) |
| 1 | 15 | 1.7 | 1.5 | 42.0 | 2.4 | 83 | 8.3 |
| 2 | 17 | 2.0 | 1.6 | 45.1 | 2.0 | 84 | 6.0 |
| 3 | 21 | 2.5 | 1.6 | 44.0 | 1.8 | 85 | 4.6 |
| 4 | 18 | 1.5 | 1.0 | 45.0 | 2.0 | 86 | 5.9 |
| 5 | 25 | 1.5 | 1.8 | 42.5 | 2.3 | 81 | 4.3 |

TABLE 2-continued

| Sample | Mean Particle Diameter (μm) Coarse Si | Fine | Coarse Si/Fine Particle Volume Ratio | Tensile Strength (kgf/mm$^2$) | Elongation (%) | Hardness ($H_RB$) | Specific Abrasion Loss (× $10^{-7}$ mm$^2$/kg) |
|---|---|---|---|---|---|---|---|
| 6 | 23 | 1.2 | 2.2 | 43.0 | 2.0 | 85 | 4.0 |
| 7 | 28 | 1.2 | 2.1 | 46.0 | 1.5 | 84 | 4.2 |
| 8 | 22 | 2.5 | 1.6 | 44.2 | 1.6 | 85 | 4.7 |
| 9 | 17 | 2.2 | 1.6 | 45.8 | 2.0 | 86 | 5.5 |
| 10 | 25 | 1.5 | 1.8 | 43.0 | 2.1 | 81 | 4.2 |
| 11* | 45 | 1.0 | 3.0 | 35.0 | 1.0 | 82 | 8.0 |
| 12* | 14 | 1.0 | 2.7 | 34.0 | 0.3 | 86 | 12.7 |
| 13* | 26 | 2.0 | 2.5 | 35.0 | 0.2 | 87 | 11.0 |
| 14* | 5 | 1.0 | 1.1 | 40.0 | 1.0 | 83 | 20.0 |
| 15* | 4 | 1.0 | 1.2 | 39.0 | 1.0 | 80 | 23.0 |

*comparative samples

From the results shown in Table 2, it is understood that the inventive samples 1 to 10 were improved in tensile strength and generally elongation and remarkably improved in abrasion resistance as compared with the comparative samples 11 to 15 because the alloy compositions were optimized and particle diameters of coarse and fine Si particles were properly controlled in the inventive samples.

EXAMPLE 2

Samples of an Al-Si alloy having the same alloy composition as the sample 1 according to Example 1 shown in Table 1 were cast at various cooling rates as shown in Table 3, and billets for extrusion were prepared similarly to Example 1. Thereafter the respective billets for extrusion were extruded at a working rate of 72% and then subjected to T6 heat treatment, similarly to Example 1. Test pieces were cut from the respective Al-alloy samples as obtained and the metallographic structures thereof were observed with a microscope to measure mean particle diameters of coarse and fine Si particles, while volume ratios of the coarse Si particles to the fine Si particles were obtained. Table 3 shows the results. Table 3 also shows data of the sample 1 according to Example 1 for reference.

TABLE 3

| Sample | Cooling Rate (°C./sec.) | Mean Particle Diameter (μm) Coarse Si | Fine | Coarse Si/Fine Particle Volume Ratio |
|---|---|---|---|---|
| 1 | 28 | 15 | 1.7 | 1.3 |
| 16 | 5 | 17* | 1.9 | 4.0 |
| 17* | 15 | 16 | 1.8 | 3.0 |
| 18* | 40 | 15 | 1.6 | 0.2 |

*comparative sample

Further, a characteristic evaluation test was carried out on the respective samples similarly to Example 1. Table 4 shows the results, along with data of the sample 1 according to Example 1 for reference. It is understood from the results shown in Tables 3 and 4 that the amount of coarse Si particles was extremely increased resulting in an increase in hardness and a reduction in elongation of the alloy while also resulting in a reduction in cuttability and deformation workability when the cooling rate in casting was less than 10° C./sec. When the cooling rate exceeded 35° C./sec., on the other hand, the amount of coarse Si particles was remarkably reduced to correspondingly reduce hardness and increase specific abrasion loss.

TABLE 4

| Sample | Tensile Strength (kgf/mm$^2$) | Elongation (%) | Hardness ($H_RB$) | Specific Abrasion Loss (× $10^{-7}$ mm$^2$/kg) |
|---|---|---|---|---|
| 1 | 42.0 | 2.4 | 83 | 8.3 |
| 16* | 40.0 | 1.5 | 84 | 6.5 |
| 17* | 42.0 | 2.0 | 84 | 7.2 |
| 18* | 38.0 | 2.6 | 80 | 10.0 |

*comparative sample

EXAMPLE 3

Samples of an Al-Si alloy having the same alloy composition as the sample 1 in Example 1 shown in Table 1 were cast at a cooling rate of 28° C./sec. by a fusion casting method, and billets for extrusion were prepared similarly to Example 1. Thereafter the respective billets for extrusion were extruded at various working rates shown in Table 5, and subjected to T6 heat treatment. Test pieces were cut from the as-obtained respective Al-Si alloy samples and the metallographic structures thereof were observed with a microscope to measure mean particle diameters of coarse and fine Si particles, while volume ratios of the coarse Si particles to the fine particles were obtained. Table 5 shows the results, along with data of the sample 1 according to Example 1 for reference.

TABLE 5

| Sample | Working Rate (%) | Mean Particle Diameter (μm) Coarse Si | Fine | Coarse Si/Fine Particle Volume Ratio |
|---|---|---|---|---|
| 1 | 72 | 15 | 1.7 | 1.5 |
| 19* | 25 | 20 | 7.0 | 1.8 |
| 20 | 50 | 17 | 2.1 | 1.6 |

*comparative sample

Further, a characteristic evaluation test was carried out on the respective samples similarly to Example 1. Table 6 shows the results, along with data of the sample 1 according to Example 1 for reference. From the results shown in Tables 5 and 6, it is understood that the particle diameters were increased in both the coarse and the fine particles when the working rate in hot plastic working was less than 30% because the Si particles were macerated in working and not refined, and hence the strength, elongation and hardness were reduced and specific abrasion loss was abruptly increased.

TABLE 6

| Sample | Tensile Strength (kgf/mm$^2$) | Elongation (%) | Hardness ($H_RB$) | Specific Abrasion Loss (× $10^{-7}$ mm$^2$/kg) |
|---|---|---|---|---|
| 1 | 42.0 | 2.4 | 83 | 8.3 |
| 19* | 30.0 | 1.3 | 75 | 16.0 |
| 20 | 41.0 | 2.5 | 80 | 8.8 |

*comparative sample

According to the present invention, as hereinabove described, the alloy structure is improved in relation to particle diameters and distribution of coarse and fine Si particles through optimization of the alloy structure and improvement of the manufacturing process, whereby it is possible to provide an aluminum alloy that is remarkably improved in strength and abrasion resistance as compared with a conventional aluminum alloy prepared by a fusion casting method. Further, the inventive aluminum alloy can be prepared from a low-priced raw material by a fusion casting method which is excellent in productivity, whereby the same can be prepared at an extremely low cost as compared with an aluminum alloy prepared by powder metallurgy.

Further, the inventive aluminum alloy is superior in plastic workability, cuttability and ductility as compared with the conventional abrasion-resistant aluminum cast/forged alloy A390, whereby it is possible to remarkably improve the working accuracy, the working yield, the working or operating life and the like of the alloy.

Therefore, the inventive abrasion-resistant aluminum alloy is applicable to an engine part, a compressor part, or a part for a sliding member or the like for an automobile in place of a conventional ferrous material, to attain remarkable effects in weight reduction and improvement in performance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of preparing an abrasion-resistant aluminum alloy by casting an aluminum alloy consisting of 13.0 to 16.0 percent by weight of Si, 4.0 to 5.0 percent by weight of Cu, at least 0.8 and less than 1.4 percent by weight of Mg, at least 0.2 and not more than 0.8 percent by weight of Fe, not more than 0.1 percent by weight of either P or at least one of Na, Sb and Sr, and a remainder of Al and unavoidable impurities and carrying out hot plastic working on said aluminum alloy at a working rate of at least 30% for homogeneously dispersing coarse Si particles of 15 to 40 μm mean particle diameter, fine Si particles of not more than 5 μm mean particle diameter and other fine particles comprising a metallic compound comprising at least one of Al, Si, Cu,. Mg, and Fe, throughout a microstructure of said alloy.

2. A method of preparing an abrasion-resistant aluminum alloy by casting an aluminum alloy consisting of 13.0 to 16.0 percent by weight of Si, 4.0 to 5.0 percent by weight of Cu, at least 0.8 and less than 1.4 percent by weight of Mg, at least 0.2 and not more than 0.8 percent by weight of Fe, not more than 0.1 percent by weight of either P or at least one of Na, Sb and Sr, not more than 0.5 percent by weight of Mn or Ni and a remainder of Al and unavoidable impurities and carrying out hot plastic working on said aluminum alloy at a working rate of at least 30% for homogeneously dispersing coarse Si particles of 15 to 40 μm mean particle diameter, fine Si particles of not more than 5 μm mean particle diameter and other fine particles comprising a metallic compound comprising at least one of Al, Si, Cu, Mg, and Fe, throughout a microstructure of said alloy.

3. The method of preparing an abrasion-resistant aluminum alloy in accordance with claim 1, wherein said aluminum alloy is cast at a cooling rate of 10° to 35° C./sec. and subjected to hot plastic working at a working rate of at least 30% so that a volume ratio of said coarse Si particles relative to said fine Si particles and said other fine particles is controlled within a range of 0.4 to 2.5.

4. The method of preparing an abrasion-resistant aluminum alloy in accordance with claim 2, wherein said aluminum alloy is cast at a cooling rate of 10° to 35° C./sec. and subjected to hot plastic working at a working rate of at least 30% so that a volume ratio of said coarse Si particles relative to said fine Si particles and said other fine particles is controlled within a range of 0.4 to 2.5.

5. An abrasion-resistant aluminum alloy consisting of 13.0 to 16.0 percent by weight of Si, 4.0 to 5.0 percent by weight of Cu, at least 0.8 and less than 1.4 percent by weight of Mg, at least 0.2 and not more than 0.8 percent by weight of Fe, not more than 0.1 percent by weight of either P or at least one of Na, Sb and Sr, and a remainder of Al and unavoidable impurities, wherein said alloy has a microstructure containing coarse Si particles of 15 to 40 μm mean particle diameter, fine Si particles of not more than 5 μm mean particle diameter and other fine particles comprising a metallic compound comprising at least one of Al, Si, Cu, Mg and Fe, with a homogeneous dispersion of said particles.

6. An abrasion-resistant aluminum alloy consisting of 13.0 to 16.0 percent by weight of Si, 4.0 to 5.0 percent by weight of Cu, at least 0.8 and less than 1.4 percent by weight of Mg, at least 0.2 and not more than 0.8 percent by weight of Fe, not more than 0.1 percent by weight of either P or at least one of Na, Sb and Sr, not more than 0.5 percent by weight of Mn or Ni, and a remainder of Al and unavoidable impurities, wherein said alloy has a microstructure containing coarse Si particles of 15 to 40 μm mean particle diameter, fine Si particles of not more than 5 μm mean particle diameter and other fine particles comprising a metallic compound comprising at least one of Al, Si, Cu, Mg and Fe, with a homogeneous dispersion of said particles.

7. The abrasion-resistant aluminum alloy in accordance with claim 5, wherein a volume ratio of said coarse Si particles relative to said fine Si particles and said other fine particles is within a range of 0.4 to 2.5.

8. The abrasion-resistant aluminum alloy in accordance with claim 6, wherein a volume ratio of said coarse Si particles relative to said fine Si particles and said other fine particles is within a range of 0.4 to 2.5.

9. The abrasion-resistant aluminum alloy in accordance with claim 5, having tensile strength of at least 38 kgf/mm$^2$ and specific abrasion loss of not more than $10\times10^{-7}$ mm$^2$/kg.

10. The abrasion-resistant aluminum alloy in accordance with claim 6, having tensile strength of at least 38 kgf/mm$^2$ and specific abrasion loss of not more than $10\times10^{-7}$ mm$^2$/kg.

11. The abrasion-resistant aluminum alloy in accordance with claim 7, having tensile strength of at least 38 kgf/mm$^2$ and specific abrasion loss of not more than $10\times10^{-7}$ mm$^2$/kg.

12. The abrasion-resistant aluminum alloy according to claim 5, wherein said Si content is greater than 15 percent by weight and said Cu content is greater than 4.5 percent by weight.

13. The abrasion-resistant aluminum alloy according to claim 6, wherein said Si content is greater than 15 percent by weight and said Cu content is greater than 4.5 percent by weight.

14. The abrasion-resistant aluminum alloy according to claim 5, wherein said coarse Si particles have a mean particle diameter greater than 20 μm.

15. The abrasion-resistant aluminum alloy according to claim 6, wherein said coarse Si particles have a mean particle diameter greater than 20 μm.

16. The abrasion-resistant aluminum alloy according to claim 5, wherein said Fe content is at least 0.25 percent by weight.

17. The abrasion-resistant aluminum alloy according to claim 5, having a positive content greater than an unavoidable impurity level of said P or at least one of Na, Sb and Sr.

18. The abrasion-resistant aluminum alloy according to claim 6, wherein said Fe content is at least 0.25 percent by weight.

19. The abrasion-resistant aluminum alloy according to claim 6, having a positive content greater than an unavoidable impurity level of said P or at least one of Na, Sb and Sr.

20. The abrasion-resistant aluminum alloy according to claim 6, having a positive content greater than an unavoidable impurity level of said Mn or at least 0.2 percent by weight of said Ni.

* * * * *

UNITED STATES PATENT AND TRADEMARK OFFICE

CERTIFICATE OF CORRECTION

PATENT NO. : 5,494,540
DATED : February 27, 1996
INVENTOR(S) : Ochi et al.

It is certified that error appears in the above-indentified patent and that said Letters Patent is hereby corrected as shown below:

Column 2: (actual line count)

line 43, after "sample 1" insert --in Example 1--;
line 44, delete "in Example 1".

Column 3: (actual line count)

line 39, delete "Mg contributes to solid" (SECOND OCCURRENCE);
line 49, delete "Fe forms deposits" (SECOND OCCURRENCE);
line 52, after "size" insert --,--.

Column 4: (actual line count)

line 6, delete ",";
line 29, delete "these"
line 37, delete "of";
line 38, delete "of";
line 41, after "(" insert --hereinafter identified as--, delete "hereinafter";
line 42, delete "identified as".

Column 7:

line 22, replace "generally elongation and" by --elongation and generally--;

UNITED STATES PATENT AND TRADEMARK OFFICE

CERTIFICATE OF CORRECTION

PATENT NO. : 5,494,540
DATED : February 27, 1996
INVENTOR(S) : Ochi et al.

It is certified that error appears in the above-indentified patent and that said Letters Patent is hereby corrected as shown below:

Column 7:

line 24, after "15" insert --,--;
line 50, replace "1.3" by --1.5

Signed and Sealed this

Sixth Day of August, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,494,540

DATED : Feb. 27, 1996

INVENTOR(S) : Ochi et al.

It is certified that error appears in the above-identified patent and that said Letters Patent is hereby corrected as shown below:

Column 7, in Table 3, in "Sample" column, replace "16" by --16*--;

in Table 3, in "Coarse Si" column, replace "17*" by --17--.

Signed and Sealed this

Twenty-ninth Day of October 1996

*Attest:*

Bruce Lehman

BRUCE LEHMAN

*Attesting Officer*

*Commissioner of Patents and Trademarks*